US007444940B2

(12) United States Patent
Kapeles et al.

(10) Patent No.: US 7,444,940 B2
(45) Date of Patent: Nov. 4, 2008

(54) VARIABLE RANGE AMMUNITION CARTRIDGE FOR ELECTRICAL DISCHARGE WEAPON

(75) Inventors: John Kapeles, Casper, WY (US); John A. Hultman, Casper, WY (US)

(73) Assignee: Defense Technology Corporation of America, Casper, WY (US)

( * ) Notice: Subject to any disclaimer, the term of this patent is extended or adjusted under 35 U.S.C. 154(b) by 352 days.

(21) Appl. No.: 11/103,711

(22) Filed: Apr. 11, 2005

(65) Prior Publication Data

US 2006/0225334 A1 Oct. 12, 2006

(51) Int. Cl.
*F41B 15/04* (2006.01)
*F41C 9/00* (2006.01)

(52) U.S. Cl. ..... 102/502; 361/232; 42/1.08

(58) Field of Classification Search ..... 361/232; 102/502, 504; 42/1.08, 84
See application file for complete search history.

(56) References Cited

U.S. PATENT DOCUMENTS 4,467,544 A * 8/1984 Gerwig ..... 42/1.08
5,654,867 A * 8/1997 Murray ..... 361/232
6,575,073 B2 * 6/2003 McNulty et al. ..... 89/1.11
2005/0262994 A1 * 12/2005 McNulty, Jr. ..... 89/1.11
2006/0067026 A1 * 3/2006 Kaufman ..... 361/232
2006/0187610 A1 * 8/2006 Su ..... 361/232
2007/0019358 A1 * 1/2007 Kroll ..... 361/232

FOREIGN PATENT DOCUMENTS

DE 2602455 A * 8/1977
FR 2450436 A * 10/1980

* cited by examiner

*Primary Examiner*—James S Bergin
(74) *Attorney, Agent, or Firm*—Christie, Parker & Hale, LLP

(57) ABSTRACT

An ammunition cartridge for an electrical discharge weapon having at least one dart positioned within a dart chamber in the housing. The cartridge has at least one adjustable barrel for selection between close and extended ranges and a joint and port for adjusting pressure in the barrel. In another form the cartridge has two fixed barrels and a retractable deflection ramp for selection between close and extended ranges.

14 Claims, 4 Drawing Sheets

VARIABLE RANGE AMMUNITION CARTRIDGE FOR ELECTRICAL DISCHARGE WEAPON

BACKGROUND OF THE INVENTION

The present invention relates generally to the field of electrical immobilization weapons of the type which impart an electrical impulse to immobilize a human target by inducing involuntary muscular contractions, and more particularly, to an improved ammunition cartridge for the electrical discharge weapon which provides for a replaceable cartridge designed to expand the operational limits of the weapon by having an adjustable barrel pressure or geometry or an adjustable dart firing angle.

Electrical discharge weapons, commonly sold under the trademark TASER, are weapons that connect a human target to a remote electrical power supply by means of a pair of darts and trailing conductors, so that the human target can be disabled by an electrical shock from the weapon. The typical power supply of an electrical discharge weapon produces low amperage shocks of 50 KV. Human beings can be disabled by shocks of much lower voltage, however, the higher voltage is needed to ionize air paths, so electrical currents can penetrate otherwise insulated garments worn by the human target to complete the shocking circuit through the body. 50 KV from a typical electrical discharge weapon will arc across an air gap of approximately two inches.

Typical ammunition cartridges for electrical discharge weapons launch their darts by the force of explosion of a chemical propellant (primer fired), or by force resulting from the release of compressed gas or spring tension. Previous primer fired ammunition cartridges are substantially rectangular in shape, and formed of a high impact plastic housing and include wire chambers positioned adjacent interior walls of the housing. The chambers open at an exit surface and are positioned at an angle with respect to each other within the cartridge housing.

When the power supply for the weapon is energized, electrical current travels from a power supply electrode to the primer and sparks through the propellant where it arcs therefrom to the conductor in the wire chamber. The current then travels through the conductor to the attached dart assembly and arcs therefrom across the exit surface to the second dart assembly. The current continues to travel through its attached conductor to an opposed electrode of the power supply, or vice versa, depending on the polarity of the supply transformer poles. The propellant contained in the primer detonates and launches the darts from the cartridge. The darts separate from each other in angled flight, and open the detonation circuit as its current can no longer complete an arc path between the darts. If the darts come within arcing distance of a human target, the shocking circuit will complete through and disable the target.

A problem with currently available ammunition cartridges is that because barrel geometries and the angle between barrels is fixed, the effectiveness between near and extended ranges is limited. For maximum effectiveness, a dart spread at the target of 5-18 inches must be maintained. This is a problem with existing ammunition cartridges because achieving optimal dart separation at closer ranges results in too much separation at longer ranges causing one of the darts to miss the target completely. Consequently a need exists for an improved ammunition cartridge which expands the operational limits of an electrical discharge weapon and maximizes its effectiveness through adjusting dart spread.

SUMMARY OF THE INVENTION

The present invention is directed to an improved ammunition cartridge for an electrical discharge weapon which expands the operational limits of current weapons and increases the effectiveness of the weapon at close and extended ranges. In a first embodiment the ammunition cartridge of the present invention is a variable range replacement cartridge incorporating one fixed geometry barrel and one adjustable geometry barrel. The adjustable barrel allows the user of the weapon to select between close and extended engagement ranges. The geometry of the adjustable barrel is controlled by a mechanism incorporated into the cartridge housing. The adjustable barrel is captured in the interior of the cartridge housing and, for example, is spring loaded to allow toggling between close and extended ranges. The barrel is sealed within the housing of the cartridge by a joint running perpendicular to the barrel centerline. When in the extended range setting, the adjustable barrel's porting is maximized and matched to the fixed barrel. When switched to close range the sealing joint is designed to induce turbulence, effectively decreasing barrel pressures and porting is incorporated in the sealing joint or housing to bleed pressure from the barrels or area ahead of the primer when the barrel is toggled to a specified position. This embodiment insures that optimum dart penetration is maintained.

In a second embodiment the ammunition cartridge allows the user to adjust the spread of the darts fired from the weapon to increase the effectiveness of the weapon at near, 1 to 15 feet, and extended, 15 to 30 feet, ranges. In this embodiment the ammunition cartridge includes the ability of adjusting the dart firing angle for short range or long range to allow an optimum dart spread at the target. The ammunition cartridge utilizes two fixed geometry barrels which diverge from each other by some specified angle. Canting of the ammunition cartridge within the weapon results in the top barrel having an orientation with a horizontal aim point, and the lower barrel is angled downward, causing the divergence of the darts as they are launched at the target. The ammunition cartridge adjusts the divergence of the darts by including a deflection ramp at a location where the dart first leaves the barrel.

The deflection ramp is positioned on the housing and is moved into place by means of a slider, shroud or other mechanism that can be actuated by hand while cartridge is in place in the weapon or outside the weapon. The deflection ramp makes a smooth transition from the launch angle of the barrel to the shallower or launch angle of the ramp. When the deflection ramp is retracted, the darts exit and travel along the centerline of the barrel, creating a divergence angle according to the angle between the two cartridge barrels. With the deflection ramp in the forward position, the effective exit angle of at least one of the darts is reduced, creating a shallower divergence angle, and less dart separation at longer ranges.

These and other aspects of the present invention will be more fully understood with reference to the following detailed description and drawings.

DETAILED DESCRIPTION OF THE INVENTION

Figure 1:
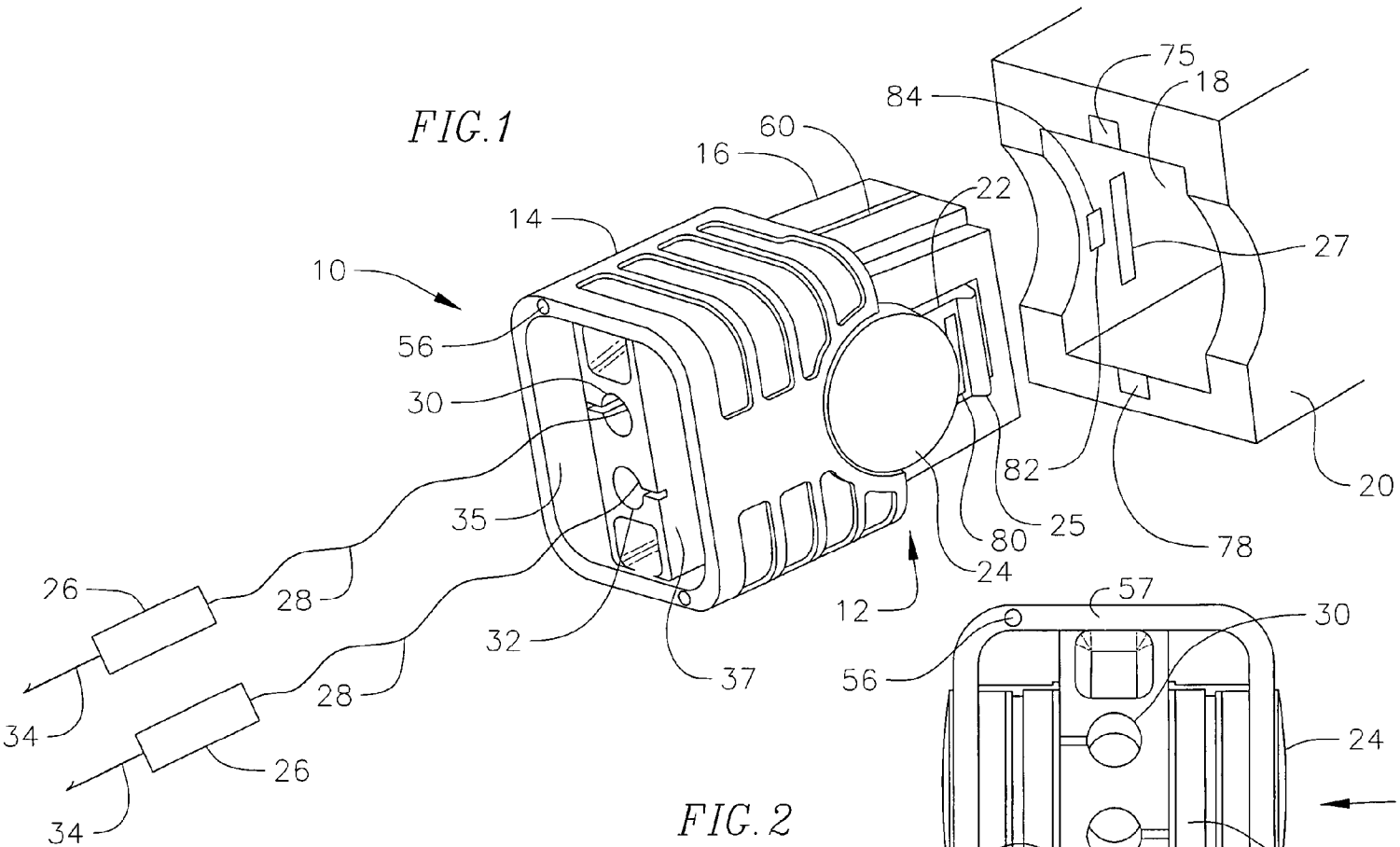
FIG. 1 is a perspective view of an ammunition cartridge of the present invention.
Figure 2:
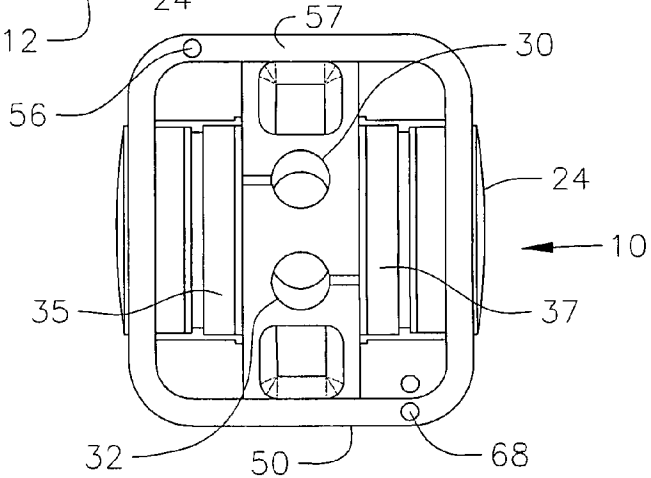
FIG. 2 is a front view of the cartridge of FIG. 1.
Figure 3:
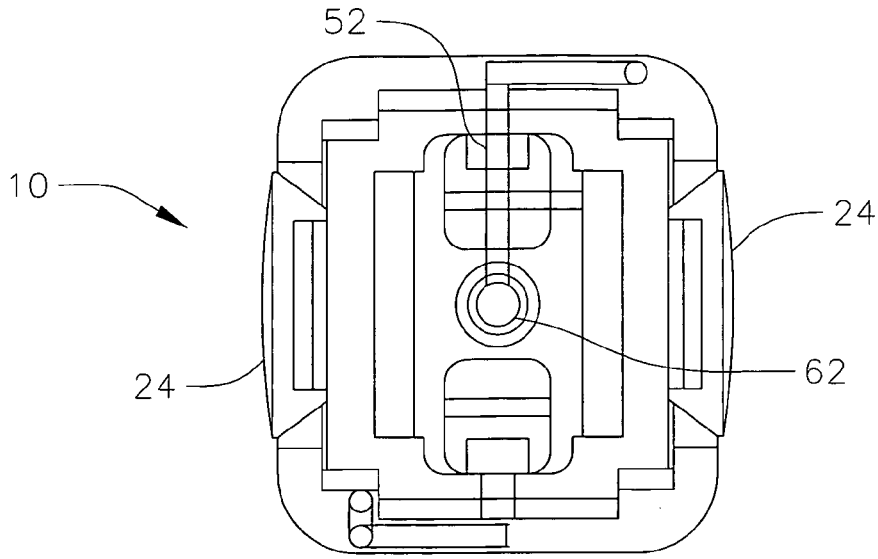
FIG. 3 is a rear view of the cartridge of FIG. 1.
Figure 4:
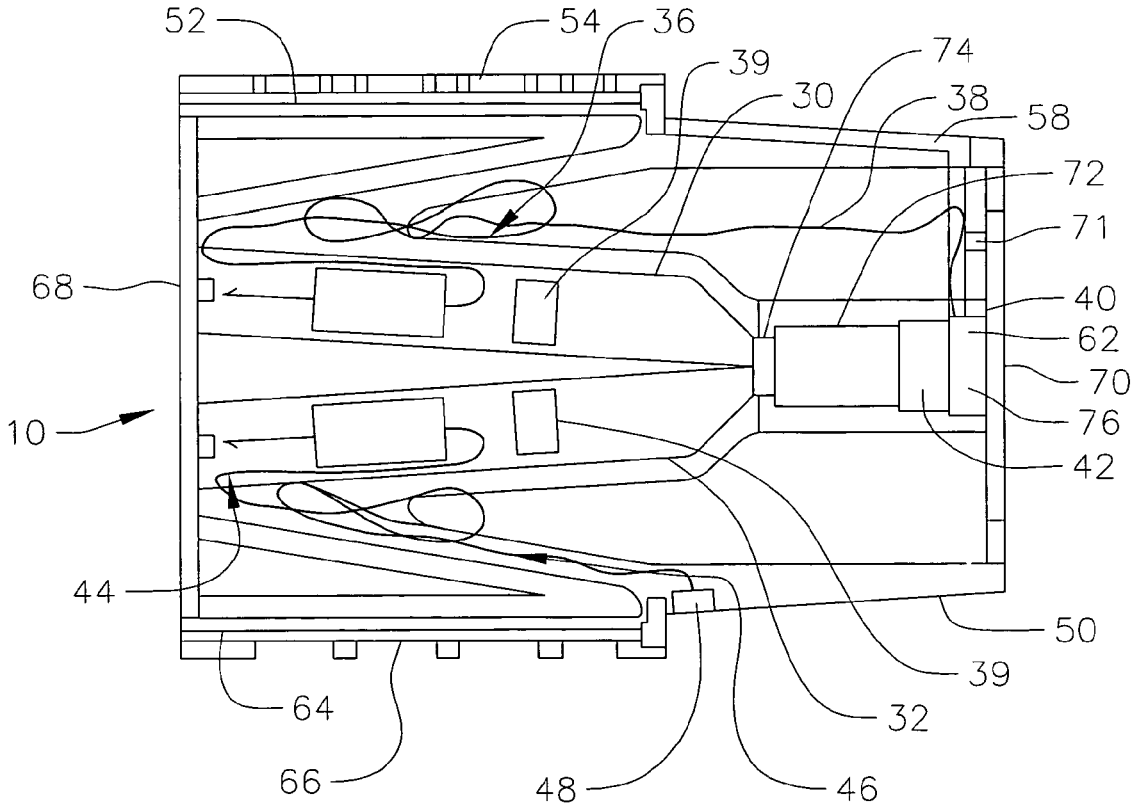
FIG. 4 is a cross-sectional view of the cartridge of FIG. 1.

Referring to FIGS. 1 through 4, an ammunition cartridge 10 of the present invention is illustrated. The cartridge has a housing 12 formed of high impact plastic having a forward section 14, and a rear section 16. Rear section 16 is received within a cavity or receiver port 18 of an electrical discharge weapon 20. Flexible flanges 22 extend along each side of the housing, and include a boss 24 to flex the flange during insertion and removal of the cartridge from the cavity 18. The flange includes a raised stop 25 for receipt into a recess 27 in port 18 to retain the cartridge in the weapon. Dart 26 and wire assemblies 28 are positioned within dart chambers 30 and 32 contained within the housing 12. Dart chambers 30 and 32 extend into the housing at an angle so that the darts when propelled from the housing separate from one another in flight. Darts 26 each include a barbed hook 34 or other means of securing to the target such as adhesive or spiked spheres for example The wire assemblies 28 include a span of insulated conductor which is wound 36 and positioned within wire storage chambers 35 and 37 adjacent the dart chambers. Wads 39 are positioned behind the darts in the dart chambers.

A first wire assembly 38 extends out of the front of dart chamber 30 through the wire storage chamber in the housing towards the rear of the housing, and terminates in an uninsulated end 40, adjacent the primer case 42. A second wire assembly 44 exits the front of dart chamber 32 and extends rearwardly through the wire storage chamber in the housing and terminates in an uninsulated end 46 at a metal rivet or contact 48 located on a surface 50 of the housing. Although the cartridge is illustrated as utilizing wire tethered darts, it is to be understood that the inventive concepts herein are equally applicable to ammunition cartridges utilizing non-wire tethered darts.

A conductive contact probe 52 extends through the housing along an upper surface 54 of first portion 14 of the housing. The contact probe terminates adjacent an opening 56 on the front surface 57 of the housing so that the contact probe is slightly recessed. The contact probe runs along the top surface 58 of the rear section 16 of the housing in a slot 60 before extending downwardly along the rear surface of the housing and terminates adjacent the rifle primer 62. A lower conductive contact probe 64 extends through the housing along the first portion 14, adjacent a lower surface 66, and terminates adjacent opening 68 along the front surface 57 of the housing, so that it is also slightly recessed. The opposite end of probe 64 terminates adjacent contact 48. Conductive probes 52 and 64 provide a power source so that the cartridge can deliver an electrical shock to a human target if the darts do not subdue the target and the cartridge is held against the target.

A front plate 68 is positioned over the front of the housing and a rear plate 70 covers the rear surface of the housing. Located between the primer 62 and the dart chambers is backing 72 and a pin 74. When the ammunition cartridge 10 is inserted into recess 18 of the electrical discharge device 20, the conductive contact probe 52 contacts electrode 75 in the electric discharge device 20. Contact 48 contacts the electrically opposed electrode 78 in the electrical discharge device. When the power supply is energized in the weapon, current travels from power supply electrode 75 through the contact probe 52 to primer 62, thereby sparking through the propellant contained in the primer to pin 74. The current then arcs therefrom to the first wire assembly 36 located in dart chamber 30 and travels through the wire assembly to the attached dart. The current arcs therefrom across the exit surface to the second dart assembly and travels through its attached wire assembly 36 until contact 48 and opposed electrode 78 of the power supply or vice versa depending upon the polarity of the supply transformer poles. The propellant contained in the primer detonates and launches the darts from the cartridge. The darts separate from each other in angled flight and open the detonation circuit as its current can no longer complete an arc path between the darts. Once the darts come within arcing distance of a human target, the shocking circuit will complete through and disable the target. Although the ammunition cartridge is illustrated as a primer fired cartridge, it is to be understood that other means of propelling the darts are contemplated, such as by compressed air or gas or by mechanical mechanisms such as springs.

The rear plate 70 is solid and is adhered to the housing by high dielectric adhesives. Such adhesives can be epoxy or ABS cement having a dielectric strength of 500 to 800 volts per mil, and the rear plate has an inside surface having ridges 71 or other areas of relief or bends to increase the arc track path. Rear plate 70 includes a raised plug 76 halved by a vertical wire slot not shown to seat over and secure the primer 62, which is recessed into the housing to increase the arc track path and limit blowback.

An aperture or depression 80 may be placed into or through flange 22 which will cause the flange to bow when the resultant forces cause the stop 25 to collide with wall 82 in recess 27. The resultant bowing of the flange will absorb some of the force. As the aperture deforms, it will cause the sides of the flange to collide with corresponding sides of wall 82, thereby stopping forward progress of the stop towards wall 82. In addition, as the aperture bows, the energy is restored as a spring force, and when released will help to reset the flange within the recess 18 of the electrical discharge weapon. A post 84 may extend outwardly from wall 82 for receipt within the aperture 80 to further retain the cartridge within recess 18.

Figure 5:
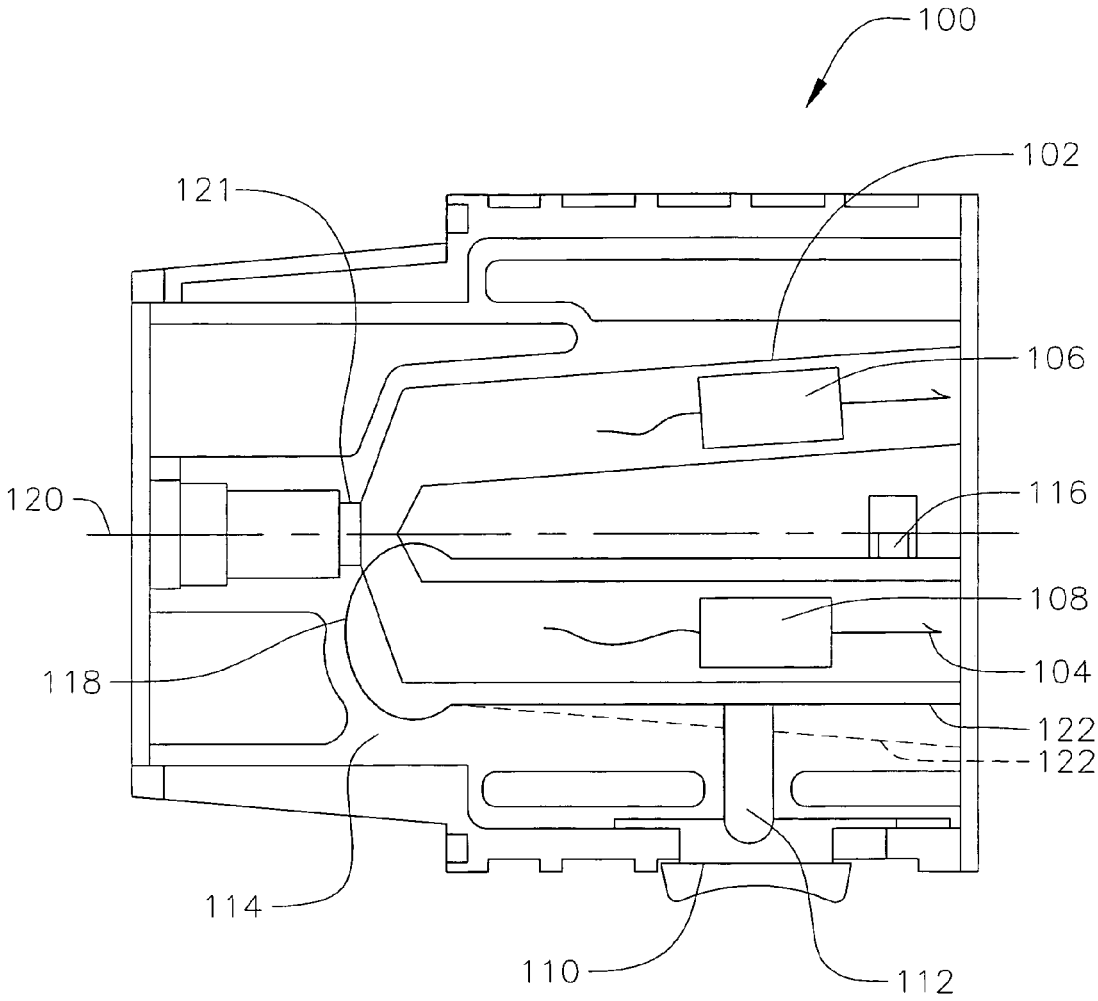
FIG. 5 is a cross-sectional view of the cartridge of FIG. 1 incorporating an adjustable geometry barrel.

Referring to FIG. 5, an ammunition cartridge 100 is illustrated, which essentially is the ammunition cartridge 10 of the prior figures modified to incorporate means for producing a variable range ammunition cartridge. Cartridge 100 incorporates one fixed dart chamber or barrel 102 and one adjustable geometry barrel 104. Alternatively, both barrels can have adjustable geometry. The adjustable barrel 104 provides for selection between close and extended engagement ranges for darts 106 and 108. The geometry of the adjustable barrel 104 is controlled by a mechanism such as a switch 110 and plunger 112. Other mechanisms can also be utilized to adjust the geometry such as a spring and plunger system, ramp and index wheel or a toggle switch. The adjustable barrel 104 is captured within the housing 114 of the cartridge and is biased by, for example, a spring, band or tensioner 116 to allow toggling between close and extended ranges. Adjustable barrel 104 is sealed to the inner housing 114 by a joint 118 which extends perpendicular to the barrel centerline 120. Joint 118 can be cylindrical, spherical or other types of joints such as ball, hinge, bellow or sleeve joints.

When the adjustable barrel is positioned in the extended range setting by the switch and plunger, the adjustable barrel's porting 121, such as by a manifold, is maximized and matched to that of the fixed barrel 102. When the switch and plunger system is moved so that the adjustable barrel is in the close range setting, the sealing joint 118 is designed to induce turbulence, effectively decreasing barrel pressures. The barrel is moved between ranges by plunger 112 sliding along surface 122, also shown in phantom for the close range position. In the extended range setting, there is little variance in the air path between the barrels, whereas in the close range setting the back pressure path of the mating surfaces of the sealing joint does not align and therefore creates turbulence in the barrel. In this manner, optimum dart penetration is maintained by separation of the darts as necessary for both the extended and close range applications.

Figure 6A:
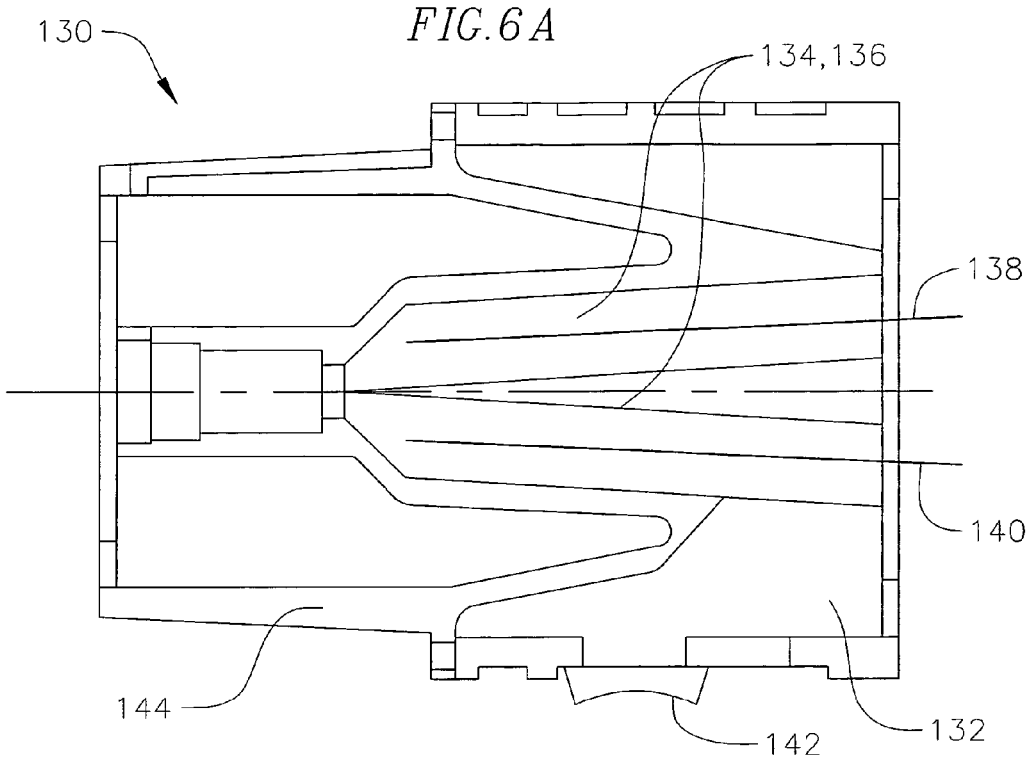
FIGS. 6A and 6B are cross-sectional views of the cartridge of FIG. 1 incorporating a deflection ramp.
Figure 6B:
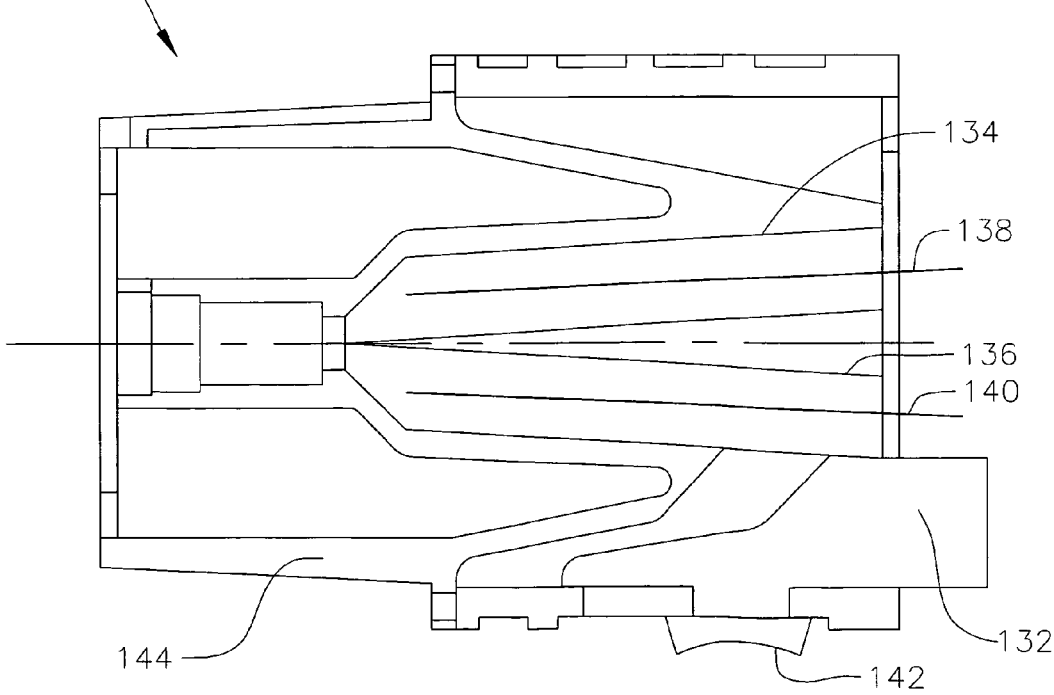

Referring now to FIGS. 6A and 6B ammunition cartridge 130 is illustrated which essentially is similar to ammunition cartridge 10 of FIGS. 1-4 and modified to incorporate a deflection ramp 132. Cartridge 130 includes two fixed geometry dart chambers or barrels 134 and 136 which diverge from each other at a preset angle. The canting of the cartridge 130 in receiver port 18 of the electrical weapon 20 (see FIG. 1) results in barrel 134 having a substantially horizontal aim point 138 and barrel 132 having an angled downwardly aim point 140. Aim point 140 causes the divergence of the darts as they are launched down range.

The divergence of the darts is adjusted by the deflection ramp 132 shown in FIG. 6A in its retracted position and in FIG. 6B in its extended position. Deflection ramp 132 includes a switch 142 or other similar mechanism for manually toggling the deflection ramp between its extended and retracted positions. The deflection ramp in its extended position is positioned within the housing 144 of the cartridge such that it is adjacent an exit point of one of the dart barrels where the dart first leaves the dart chamber. The deflection ramp makes a smooth transition from the launch angle of the dart in the retracted position to a shallower launch angle when in the extended position. Although only one deflection ramp is shown in the figures, it is to be understood that a deflection ramp could be utilized for both dart chambers. Although the deflection ramp is illustrated as a ramp, other structures could also be utilized, such as a tube, tang, flange or cowl. Switch 142 could be any other alternative means such as a slider, shroud or other mechanism which could be actuated by hand while the cartridge is positioned within the weapon or outside of the weapon.

When the deflection ramp is in its retracted position the darts exit and travel along the centerline of the dart chambers creating a divergence angle according to the angle between the two dart chambers. With the deflection ramp in the forward position the effective exit angle of one of the dart chambers is reduced, creating a shallower divergence angle and less dart separation at longer ranges. In use, for close range, the deflection ramp would be in its retracted position, and placed in its extended position for long range applications. Close ranges typically are approximately 1 to 15 feet and long ranges are approximately 15 to 30 feet. The deflection ramp therefore achieves an effective dart spread of 5 to 18 inches for both near and distant applications.

The present invention has been described and illustrated with respect to two embodiments thereof, however, it is to be understood that the invention is not to be so limited, since changes and modifications can be made therein without departing from the scope of the invention as hereinafter claimed.

What is claimed is:

1. An ammunition cartridge for an electrical discharge weapon comprising:

a housing having a first dart chamber and a second dart chamber located within the housing;

a dart positioned in each of the first dart chamber and second dart chamber;

a propellant for launching each dart; and means for adjusting pressure in one of the first dart chamber or the second dart chamber.

2. The ammunition cartridge of claim 1, wherein the means for adjusting pressure includes one of a spring, band or tensioner for biasing the first dart chamber or the second dart chamber.

3. The ammunition cartridge of claim 1, wherein the means for adjusting pressure includes a sealing joint between one of the first dart chamber or the second dart chamber and the housing.

4. The ammunition cartridge of claim 1, wherein the means for adjusting pressure includes a switch and plunger for moving one of the first dart chamber or the second dart chamber.

5. The ammunition cartridge of claim 1, wherein the means for adjusting pressure includes generating turbulence in one of the first dart chamber or the second dart chamber.

6. The ammunition cartridge of claim 1 wherein the means for adjusting pressure includes at least one port for bleeding pressure from one of the first dart chamber or the second barrel.

7. The ammunition cartridge of claim 1 wherein one of the first dart chamber or the second dart chamber has an adjustable geometry.

8. An ammunition cartridge for an electrical discharge weapon comprising:

a housing having an exterior surface and a first barrel and a second barrel located within the housing;

a dart positioned in each of the first barrel and the second barrel;

a propellant for launching each dart from the first barrel and the second barrel;

means for adjusting the geometry of one of the first barrel or the second barrel; and means for biasing one of the first barrel or the second barrel in the housing.

9. The ammunition cartridge of claim 8 further having means for adjusting pressure in one of the first barrel or the second barrel.

10. The ammunition cartridge of claim 9 wherein the means for adjusting pressure includes a joint between one of the first barrel or the second barrel and the housing.

11. The ammunition cartridge of claim 9 wherein the means for adjusting pressure includes a port for removing pressure from one of the first barrel or the second barrel.

12. The ammunition cartridge of claim 8 wherein the means for adjusting the geometry of one of the first barrel or the second barrel includes a joint between one of the first barrel or the second barrel and the housing.

13. The ammunition cartridge of claim 12 wherein the means for adjusting the geometry includes a mechanism for moving one of the first barrel or the second barrel.

14. The ammunition cartridge of claim 8 wherein the means for biasing one of the first barrel or the second barrel is a spring located in the housing adjacent one of the first barrel or the second barrel.

* * * * *